US009073686B2

(12) United States Patent
Medina-Elizondo

(10) Patent No.: US 9,073,686 B2
(45) Date of Patent: Jul. 7, 2015

(54) SEPARATOR-SHOCK ABSORBER FOR TRANSPORTABLE LOADS

(76) Inventor: David-Israel Medina-Elizondo, Monterrey (MX)

( * ) Notice: Subject to any disclaimer, the term of this patent is extended or adjusted under 35 U.S.C. 154(b) by 424 days.

(21) Appl. No.: 13/455,314

(22) Filed: Apr. 25, 2012

(65) Prior Publication Data

US 2012/0273312 A1 Nov. 1, 2012

(30) Foreign Application Priority Data

Apr. 29, 2011 (MX) ..... EMX/a/2011/004544

(51) Int. Cl.
*B65D 81/127* (2006.01)
*B65D 81/02* (2006.01)

(52) U.S. Cl.
CPC ..... *B65D 81/02* (2013.01)

(58) Field of Classification Search
USPC ..... 206/5, 522, 600, 521.7, 523, 586, 593; 220/6, 560.01
See application file for complete search history.

(56) References Cited

U.S. PATENT DOCUMENTS

| | | | | |
|---|---|---|---|---|
| 7,028,834 | B2 * | 4/2006 | Karpel | 206/5 |
| 8,052,002 | B2 * | 11/2011 | Spindel et al. | 220/6 |
| 2003/0080024 | A1 * | 5/2003 | Vourganas | 206/600 |
| 2007/0095711 | A1 * | 5/2007 | Thompson et al. | 206/522 |

* cited by examiner

*Primary Examiner* — Christopher Schwartz
(74) *Attorney, Agent, or Firm* — Young & Thompson

(57) ABSTRACT

A separator-shock absorber to avoid that charges which are going to be transported by land, by sea or by air collide and damage the loads collision to each other and damage the loads, and including: a retention base; a retention element near to a first end of the retention base; a separator-shock absorber member having a first articulated end and a second end to be coupled to the retention base; a retention element at the second end of the separator-shock absorber member, cooperating with the retention element of the first end of the retention base, in order to regulate the width of the separator-shock absorber member when it is articulated, to be coupled to the retention element of the retention base.

20 Claims, 6 Drawing Sheets

SEPARATOR-SHOCK ABSORBER FOR TRANSPORTABLE LOADS

FIELD OF THE INVENTION

This invention refers to a separator-shock absorber to avoid that the loads to be transported by land, by sea or by air collide and damage the loads.

BACKGROUND OF THE INVENTION

Hitherto, when transporting risk loads which can be broken, crash or damage, such as bottles and articles of glass or other materials, or any other risk articles, and which usually are transported on pallets, bubbles plastic trips are used to independently surround the articles and relatively avoid that these loads be damaged by collision when are transported.

Balloons or air bags made of relatively resistant plastic have also been used introducing them between the loads to reduce the risk of damage of the loads by collision when transported.

However, the use of said bubbles plastic strips and air bags have the risk of leave the loads without protection, mainly by the changes of temperature and height above sea level, to which the loads are subjected to during its transportation, which may cause that the balloons and air bags unduly inflate or deflate to inconvenient limits and consequently do not suitable protect the load, causing breaking, crashing or damaging thereof.

Furthermore, the plastic air bags have to be produced in several dimensions because they cannot be graduated to be adjusted to diverse spaces between the loads without losing their inflation condition to resist collisions between the loads.

SUMMARY OF THE INVENTION

It is therefore a main object of the invention, to provide a separator-shock absorber for transportable loads, which separates the loads to each other in order to absorb shocks among the loads during its natural movements when they are transported.

It is also a main object of the present invention, to provide a separator-shock absorber for transportable loads, of the above disclosed nature, which is resistant to heavy loads, for example pallets of 1 or 2 tons, protecting them and avoiding damages thereto due to its natural movements when transported.

It is a further object of the present invention, to provide a separator-shock absorber for transportable loads, of the above disclosed nature, which can be graduated as a function of the separation of its components and the separation of the loads to each other and of the diverse nature of the loads, to avoid that the loads be damaged due to the natural movement during its transportation.

These and other objects and advantages of the separator-shock absorber for transportable loads, of the present invention, will be apparent from the following detailed description of the specific embodiments of the invention, which are provided as an illustration but not as a limitation of the present invention and its scope will be defined exclusively by the accompanying claims, duly supported by this specification and by the accompanying drawings.

DESCRIPTION OF THE PREFERRED EMBODIMENTS OF THE INVENTION

Figure 1:
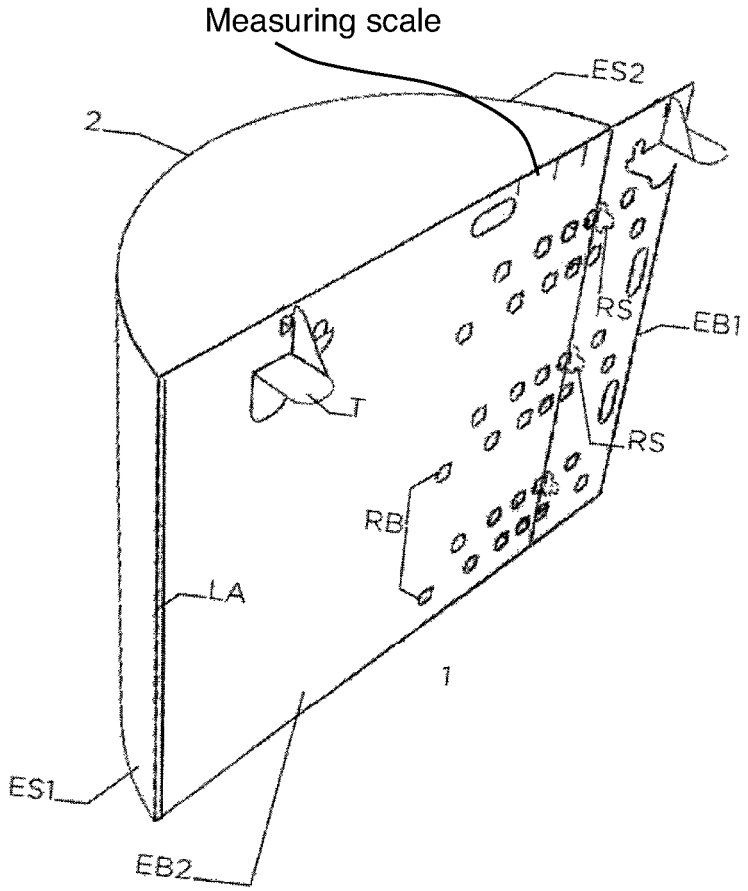
FIG. 1, is a conventional perspective view of a first embodiment of the separator-shock absorber for transportable loads, of the present invention, sowing a separator-shock absorber member is a curved way and an embodiment of articulation with a separator-shock absorber member.

In the following the invention will be described making reference to the accompanying drawings, in which the same signs refer to the same parts of the shown figures, and wherein:

In a first embodiment of the separator-shock absorber, of the present invention, to be placed between transportable loads in order to separate them and avoid collision to each other, shown in FIG. 1 of the accompanying drawings, comprising: a retention base 1 having a first end EB1 and a second end EB2; retention elements shown in this embodiment as retention grooves or recesses RB, near to the first end EB1 of the retention base 1; a separator-shock absorber member 2 having a first end ES1 articulated at the second end EB2 of the retention base 1 and a second end ES2; retention elements shown as retention tongs RS at the second end ES2 of the separator-shock absorber member, cooperating with the retention recesses RB of the first end EB1 of the retention base 1, in order to regulate the width of the separator-shock absorber member 2 when it is articulated in the end EB2 of the retention base 1, to be coupled to the retention recess RB of the retention base 1.

The retention base 1 can include marks having diverse measuring scales, to graduate the distance between the diverse retention recesses RB and providing the width and dimensions of separation and cushioning between the loads.

When the separator-shock absorber of the present invention is made of resistant cardboard the separator-shock absorber member 2 is integrally articulated, by its first end ES1 to the second end EB2 of the retention base 1 by means of an articulation line LA (FIG. 1) pressed or stamped at the second end EB2 of the retention base 1. In this case, the separator-shock absorber member 2 is made from a sheet integral to the retention base 1 which is curved, as shown in said FIG. 1, to insert its retention tongs RS into the retention recesses RB of the retention base 1 and be place in a vertical position orienting the curved portion of the separator-shock absorber member 2 placed between the loads. In this embodiment the retention recesses can include commercially available prefabricated retention recesses, usually of plastic, insertable into the retention grooves or recesses RB.

Figure 2:
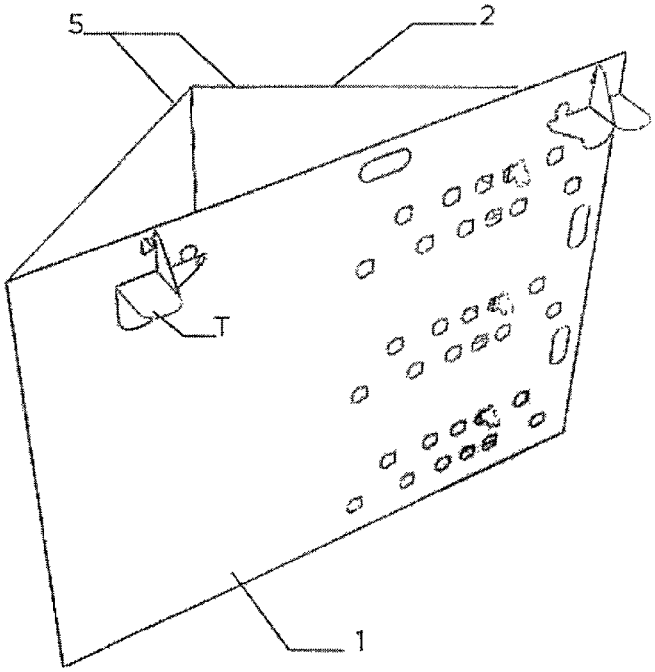
FIG. 2, is a conventional perspective view of a second embodiment of the separator-shock absorber of the present invention, showing a different embodiment of retention base, of articulation elements between the retention base and a separator-shock absorber of two sections, forming a triangle.
Figure 4:
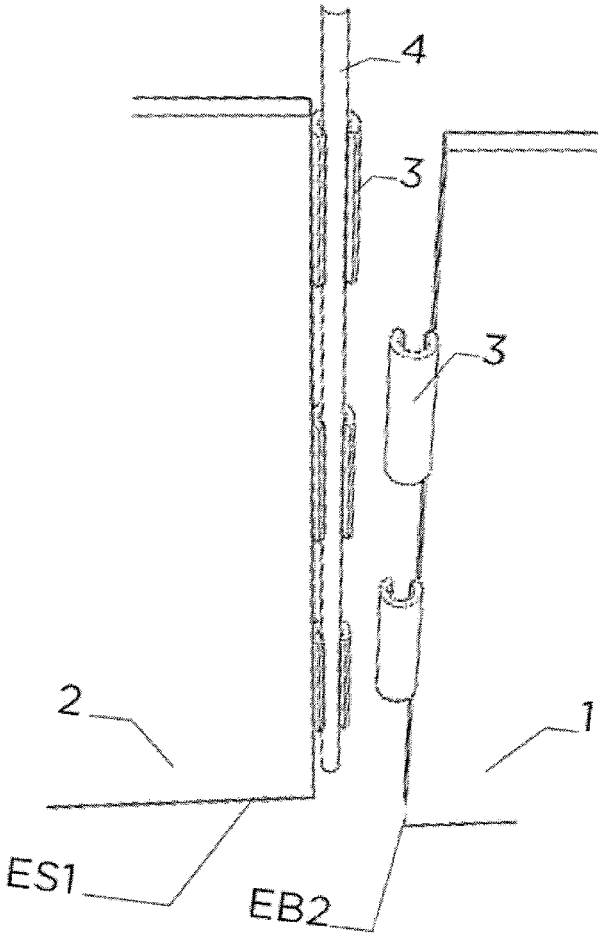
FIG. 4, is a detailed conventional perspective view, of the articulation between the retention base and a separator-shock absorber member.
Figure 5:
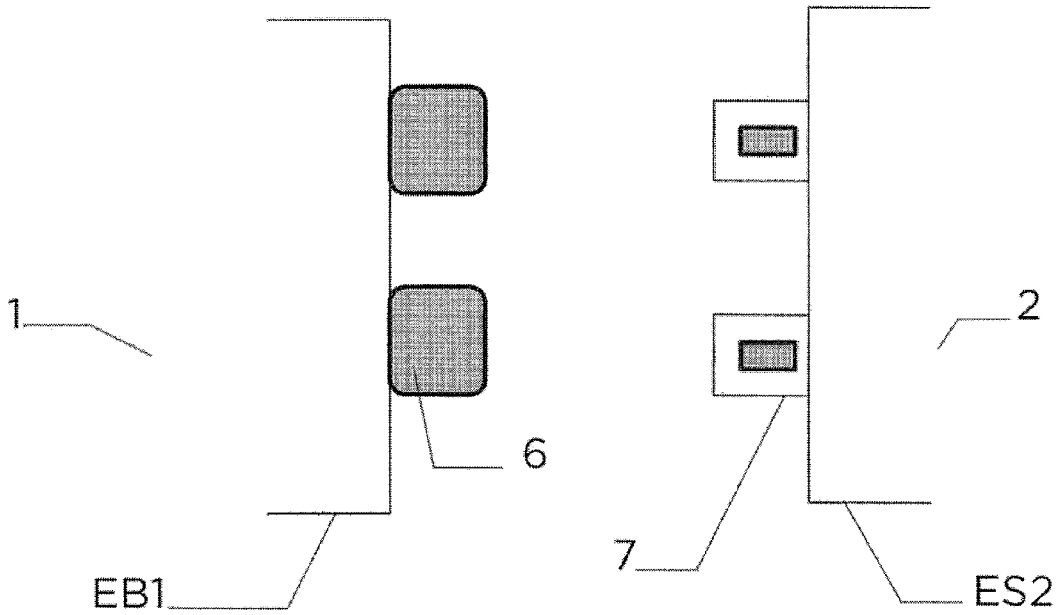
FIG. 5, is a partial top plant view of the second embodiment of the retention elements both in the retention base as in a separator-shock absorber.
Figure 6:
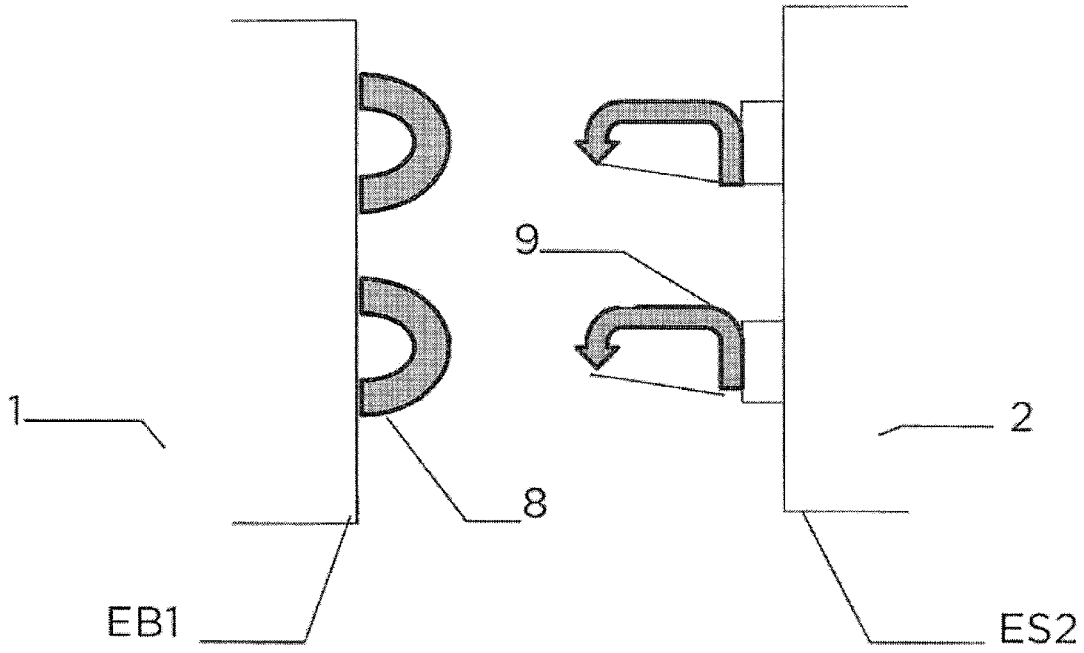
FIG. 6, is a partial top plant view of a third embodiment of the retention elements both in the retention base as in a separator-shock absorber.

Or else, when the separator-shock absorber of the present invention is made of rigid plastic, wood or metal, the separator-shock absorber member 2 is articulated, by its first end ES1 to the second end EB2 of the retention base 1, by means of a hinges 3 and pins 4 assemblies as shown in FIG. 2 and FIG. 4, which articulately retain the separator-shock absorber member 2 to said second end EB2 of the retention base 1. In this case, said separator-shock absorber 2 comprises two or more sheets 5 of plastic, wood or metal articulated to each other by means of additional hinges 3 and pins 4 assemblies; and the retention recesses RB of the first end ER1 of the retention base 1 are substituted by buckles 6 and the retention tongs RS of the second end ES2 of the separator-shock absorber member 2, are substituted by perforated plates 7 as shown in detail in FIG. 5 or else, the buckles 6 and perforated plates 7, are substituted by rings 8 and the buckles 6 are substituted by a hook with latch 9 which hold the rings 8 in order to retain the separator-shock absorber member 2 at the required distance to separate the loads (not illustrated) and cushioning its movements during transportation thereof.

Both, the retention recesses RB or rings of the retention base 1, as the tongs RS or hook with latch 9 of the separator-shock absorber member 2 are distributed at diverse distances to each other in order to regulate the desired width of the separator-shock absorber member 2.

Figure 3:
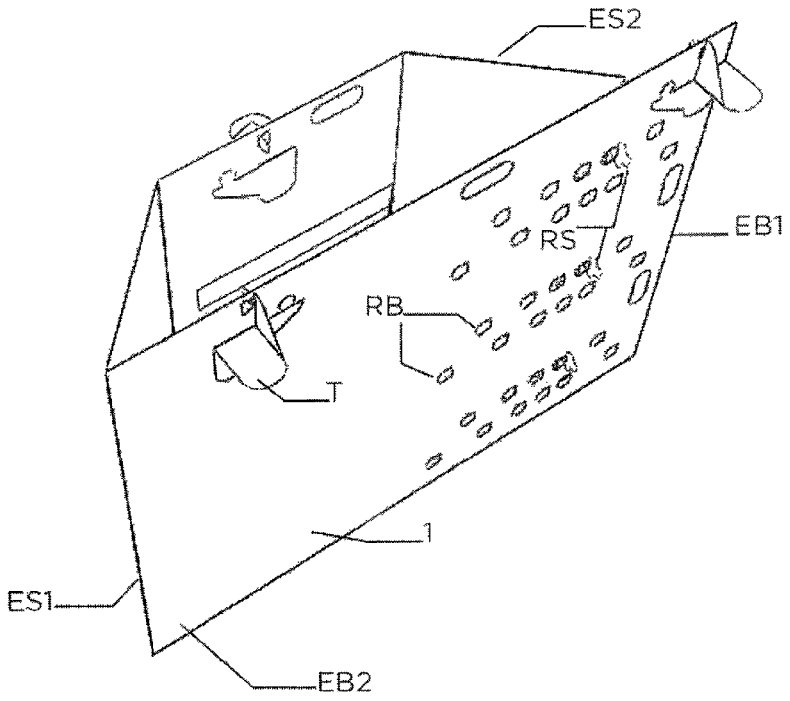
FIG. 3, is a conventional perspective view of a third embodiment of the separator-shock absorber for transportable loads, of the present invention, assembled in a trapezoidal form.

When the separator-shock absorber member consists of two or more sheets of any suitable material, depending on the number thereof, will form a triangle as in FIG. 2, trapeze as in FIG. 3, rectangle or any other polyhedron figure regarding the retention base.

The separator-shock absorber member may include a device in an inverted T shape presenting a flat section directed downwards in order to be retained in the top edge of the loads.

Furthermore, it is possible to manufacture two separator-shock absorbers in a single integral or articulated piece in order to place one adjacent and opposite to the other so that remain opposed to each other (not illustrated).

Although the above description includes many specifications, these should not be construed as limitative of the scope of the invention, but as illustrations provided regarding the currently preferred embodiments of this invention.

Therefore, the scope of the invention should be determined by the accompanying claims of the formal application and its legal equivalents instead of only the described embodiments.

I claim:

1. A separator-shock absorber to be placed between loads in order to separate two adjacent loads and avoid collision to the two adjacent loads during transport, said separator-shock absorber comprising:

a retention base having a first end, a second end, and first retention means near the first end of the retention base; and a separator-shock absorber member having i) a first end articulated to the second end of the retention base, and ii) a second end that ends with second retention means, wherein the second retention means cooperates with the first retention means to regulate a desired width of the separator-shock absorber member against the retention base.

2. The separator-shock absorber, as claimed in claim 1, wherein the retention base further comprises a measuring scale corresponding to plural widths of the separator-shock absorber member being regulated against the retention base including first and second widths of the separator-shock absorber member against the retention base respectively that in turn define at least i) a smaller, first separation distance or cushioning between the two adjacent loads and ii) a larger, second separation distance or cushioning between the two adjacent loads.

3. The separator-shock absorber, as claimed in claim 1, wherein the first end of the separator-shock absorber member is integrally articulated to the second end of the retention base.

4. The separator-shock absorber, as claimed in claim 1, wherein the first end of the separator-shock absorber member is articulated to the second end of the retention base by means of hinges and pins assemblies which articulately retain the separator-shock absorber member to said second end of the retention base.

5. The separator-shock absorber, as claimed in claim 1, wherein the separator-shock absorber member is semi-circularly curved for coupling the second retention means to the first retention means, to provide a cushioning space between the two adjacent loads.

6. The separator-shock absorber, as claimed in claim 1, wherein the separator-shock absorber member comprising two or more sections articulated to each other, a first of the sections starting at the first end of the separator-shock absorber member, and a free end of a last of the sections comprising the second retention means.

7. The separator-shock absorber, as claimed in claim 1, further comprising an inverted T shape device presenting a flat section directed downwards in order to be retained in a top edge of one of the two adjacent loads when the separator-shock absorber is separating the two adjacent loads.

8. The separator-shock absorber, as claimed in claim 1, wherein the first retention means of the retention base comprises a plurality of individual retention recesses distributed at diverse distances to each other, in order to regulate a desired width or separation between the two adjacent loads, of the separator-shock absorber member.

9. The separator-shock absorber, as claimed in claim 1, wherein the first retention means of the retention base are female members and the second retention means of the separator-shock absorber member are male members that selectively cooperate with each other in a male-female arrangement so that retain the separator-shock absorber member against the retention base at a desired distance to provide the desired width of the separator-shock absorber member against the retention base, wherein each of the male members selectively cooperates with a selected one of the female members to regulate the width of the separator-shock absorber member against the retention base such i) with the male members cooperating with the female members located a first position nearest the first end of the retention base, a widest, first width of the separator-shock absorber member against the retention base and a smaller, first separation distance or cushioning between the two adjacent loads results, and ii) with the male members cooperating with the female members located at a final position furthest from the first end of the retention base, a narrowest, second width of the separator-shock absorber member against the retention base and a larger, second separation distance or cushioning between the two adjacent loads results.

10. The separator-shock absorber, as claimed in claim 1, wherein the retention base and the separator-shock absorber member, are manufactured as a one single piece made of paperboard or plastic, and the separator-shock absorber member is articulated to the second end of the retention base by means of a stamped articulation line between the second end of the retention base and the first end of the separator-shock absorber member.

11. The separator-shock absorber, as claimed in claim 1, wherein the retention base and the separator-shock absorber member are manufactured as a one single piece made of paperboard or plastic, and the separator-shock absorber member is relatively flexible to be curved in order to be coupled to the retention means of its second end, with the retention means of the first end of the retention base.

12. The separator-shock absorber, as claimed in claim 1, wherein the retention base and the separator-shock absorber member are made of paperboard, plastic or metal, and the retention base and separator-shock absorber member are articulately coupled to each other by means of hinges and pins assemblies, and the separator-shock absorber member comprises two or more sections articulated to each other, a first of the sections starting at the first end of the separator-shock absorber member, and a free end of a last of the sections comprising the second retention means.

13. The separator-shock absorber, as claimed in claim 1, wherein the separator-shock absorber member comprises two sections which are articulated to each other to form a triangle with the retention base.

14. The separator-shock absorber, as claimed in claim 1, wherein the separator-shock absorber member comprises three sections which are articulated to each other to form a trapezium with the retention base.

15. The separator-shock absorber, as claimed in claim 1, wherein separator-shock absorber member comprises more than three sections which are articulated to each other to form a polygon with the retention base.

16. The separator-shock absorber, as claimed in claim 1, wherein the separator-shock absorber member comprises a plurality of apertures, and the second retention means of the separator-shock absorber member comprises a plurality of tongs to be introduced into the apertures of the retention base.

17. The separator-shock absorber, as claimed in claim 1, wherein the first retention means of the retention base comprises a plurality of retention stops and the second retention means of the separator-shock absorber member comprises a plurality of tongs for retaining abut against the apertures of the retention base.

18. The separator-shock absorber, as claimed in claim 1, wherein the first retention means of the retention base comprises a plurality of retention rings and the second retention means of the separator-shock absorber member comprises a plurality of retention buckles or bars or retention hooks with latch which are introduced into retention bars of the retention base.

19. A separator-shock absorber for placing between loads in order to separate two adjacent loads and avoid collision of the two adjacent loads during transport, said separator-shock absorber comprising:

a retention base having a first end, a second end, and first retention means near the first end of the retention base, the first retention means comprising plural positions respectively located at different distances from the first end of the retention base; and a separator-shock absorber member having i) a first end articulated to the second end of the retention base, and ii) a second end that ends with second retention means, wherein the second retention means selectively cooperate with the first retention means at a selected one of the positions to regulate a desired width of the separator-shock absorber member against the retention base such i) with the second retention means cooperating with a first position of the retention means located nearest the first end of the retention base, a widest, first width of the separator-shock absorber member against the retention base and a smaller, first separation distance between the two adjacent loads results, and ii) with the second retention means cooperating with a final position of the retention means located furthest the first end of the retention base, a narrowest, second width of the separator-shock absorber member against the retention base and a larger, second separation distance between the two adjacent loads results.

20. The separator-shock absorber, as claimed in claim 19, wherein, the first retention means are female members, and the second retention means are male members that cooperate in a male-female arrangement with the female members at the selected one of the positions so as to retain the separator-shock absorber member against the retention base at the desired width to thereby obtain a desired one of the first and second separation distances between the two adjacent loads.

* * * * *